US010348000B2

(12) United States Patent
Fischer et al.

(10) Patent No.: US 10,348,000 B2
(45) Date of Patent: Jul. 9, 2019

(54) THERMAL OVERCURRENT CIRCUIT BREAKER

(71) Applicant: Ellenberger & Poensgen GmbH, Altdorf (DE)

(72) Inventors: Erich Fischer, Altdorf (DE); Wolfgang Schmidt, Berg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 15/236,787

(22) Filed: Aug. 15, 2016

(65) Prior Publication Data

US 2016/0352026 A1 Dec. 1, 2016

Related U.S. Application Data

(63) Continuation of application No. PCT/EP2015/000060, filed on Jan. 15, 2015.

(30) Foreign Application Priority Data

Feb. 13, 2014 (DE) ..... 10 2014 002 026

(51) Int. Cl.
*H01R 4/48* (2006.01)
*H01H 5/00* (2006.01)
(Continued)

(52) U.S. Cl.
CPC ..... *H01R 4/4827* (2013.01); *H01H 5/00* (2013.01); *H01H 71/08* (2013.01); *H01H 71/16* (2013.01); *H01H 73/26* (2013.01); *H01R 4/4836* (2013.01)

(58) Field of Classification Search
CPC .... H01R 4/4827; H01R 4/4836; H01H 71/16; H01H 5/00; H01H 71/08; H01H 73/26;
(Continued)

(56) References Cited

U.S. PATENT DOCUMENTS 3,781,857 A * 12/1973 Stendig ..... H01R 13/703 340/521
4,167,720 A * 9/1979 Krasser ..... H01H 71/54 337/350
(Continued)

FOREIGN PATENT DOCUMENTS

DE 27 21 162 11/1978
DE 94 22 029 U1 10/1997
(Continued)

OTHER PUBLICATIONS

Sasano Naoya; Sato Makoto; Tomizu Motoyuki; Yamane Jun; Iwasaki Shinya; Yeno Naoki, Conductor Connecting Instrument, and Relay Unit Using the Same, Omron Tateisi Electronics Co, Entire Document (Translation of JP 2013058390).*
(Continued)

*Primary Examiner* — Jerry Wu
*Assistant Examiner* — Stephen S Sul
(74) *Attorney, Agent, or Firm* — Muncy, Geissler, Olds & Lowe, P.C.

(57) ABSTRACT

A thermal overcurrent circuit breaker having a switch housing in which a thermal expansion element and a snap-action switching mechanism, which is coupled to the thermal expansion element and can be manually operated, and also a moving contact, which interacts with the snap-action switching mechanism, and a fixed contact are arranged, the fixed contact being connected to a first connection rail while contact is made with the moving contact by a second connection rail by means of the thermal expansion element. The switch housing has a number of connection chambers in which in each case one of the connection rails is arranged, wherein a two-limb spring element for making clamping contact with a connection line, which is guided into the
(Continued)

connection chamber via a first housing opening and has the connection rail, is arranged in each connection chamber.

10 Claims, 3 Drawing Sheets

(51) Int. Cl.
*H01H 71/16* (2006.01)
*H01H 71/08* (2006.01)
*H01H 73/26* (2006.01)

(58) Field of Classification Search
CPC ..... H01H 13/26; H01H 19/32; H01H 2037/5463; H01H 2037/5481; H01H 37/54; H01H 37/5418; H01H 13/22
USPC ..... 337/36, 37, 52, 53, 89, 131, 333, 334, 337/343, 359, 362, 365, 379, 390
See application file for complete search history.

(56) References Cited

U.S. PATENT DOCUMENTS 5,451,729 A * 9/1995 Onderka ..... H01H 71/0207 200/18
6,094,126 A 7/2000 Sorenson
6,146,186 A * 11/2000 Barrat ..... H01R 4/2416 439/410
6,154,116 A 11/2000 Sorenson
7,115,001 B1 * 10/2006 Brockman ..... H01R 4/4827 439/828
2007/0170047 A1 * 7/2007 Ullermann ..... H01H 23/164 200/339
2009/0253306 A1 * 10/2009 Knoerrchen ..... H01R 4/4836 439/651

FOREIGN PATENT DOCUMENTS

DE 10 2010 050 870 A1 4/2012
EP 1 936 744 A2 6/2008
EP 2 568 539 A2 3/2013
JP 2001 006 513 A 1/2001
JP 2002 151 175 A 5/2002
JP 2013058390 A * 3/2013 ..... H01R 4/4827
JP 2013 227 527 A 11/2013

OTHER PUBLICATIONS

Imai Katsuya, Kanemoto Naoki, Kotsuna Masahiro, Sumino Yasuhiro, Tateishi Hiroyuki, Takagi Tatsuya, Suzuki Takeshi, "Terminal Device", May 24, 2002, Matsushita Electric Works LTD, Entire Document (Translation of JP2002151175, of record in IDS filed on Sep. 18, 2017).*
Japanese Office Action with English Translation.

* cited by examiner

THERMAL OVERCURRENT CIRCUIT BREAKER

This nonprovisional application is a continuation of International Application No. PCT/EP2015/000060, which was filed on Jan. 15, 2015, and which claims priority to German Patent Application No. 10 2014 002 026.6, which was filed in Germany on Feb. 13, 2014, and which are both herein incorporated by reference.

BACKGROUND OF THE INVENTION

Field of the Invention

The invention relates to a thermal overcurrent circuit breaker with a switch housing in which a thermal expansion element, in particular a bimetal, and a manually operated snap-action switching mechanism coupled thereto, and a moving contact cooperating therewith and a fixed contact are arranged, which is connected to a first connection rail while the moving contact is contacted with a second connection rail via the thermal expansion element.

Description of the Background Art

In a thermal circuit breaker, the trigger point depends on the amount of overcurrent. With increasing current, an expansion element, in particular a bimetal, is increasingly heated up to a defined trigger point. The thermal expansion element is coupled, for example, to a trip-free, manually operable snap-action mechanism which interacts with a moving contact of a contact pair. Such a circuit breaker, also referred to as an overcurrent circuit breaker, with thermal triggering usually serves to protect loads such as electric motors, household and office equipment, power tools, power supplies and low voltage lines against overcurrent. Such circuit breakers can be designed single-pole, two-pole or three-pole and are used for rated voltages of AC (alternating current) 240V or DC (direct current) 50V with current ratings in the range between 0.1 A and 20 A.

A thermal overcurrent circuit breaker of the mentioned type is known for example from DE 27 21 162 A1, which corresponds to U.S. Pat. No. 4,167,720, and from DE 94 22 029 U1, which corresponds to U.S. Pat. No. 5,451,729. In the known circuit breakers, the connections to the contact pair, that is, to the fixed contact and via a bimetal to the moving contact carried by a contact spring, are designed as so-called tab connectors which lead out of the switch housing on a connection side opposite an ON/OFF switching rocker.

The connection of lines is made with flat plug sockets or by means of cable lugs screwed with the flat plugs.

SUMMARY OF THE INVENTION

It is therefore an object of the present invention to provide an improved thermal circuit breaker, in particular in respect of touch protection, easy connection and contact and connection safety.

In an exemplary embodiment, the thermal overcurrent circuit breaker has a switch housing with a plurality of connection chambers, in each of which a connection rail and a two-limb spring element for clamp contacting of a connection line that is guided through a housing opening into the respective connection chamber are arranged there with the connection rail. Preferably, each spring element has a first spring limb and a second spring limb extending at an angle thereto. A second housing opening opens into the respective connection chamber, the housing opening overlapping from the second spring limb of the spring element to its resting position and being provided for pivoting actuation of this spring limb.

The switch housing also can include a contact chamber extending between an operating side for a manually operable switching element and the connection chambers in which the snap-action switching mechanism and the thermal expansion element and the contact pair of movable and fixed contacts are arranged.

The first spring limb is supported in a contacting manner on a first rail or connecting limb of the connection rail. The angle between the two spring limbs of the spring element is preferably greater than 45°, most preferably greater than 60°, and smaller than 180°, in particular smaller than or equal to 90°. The second spring limb can be moved within the connection chamber from a contact position that preferably at least partially overlaps both the second housing opening and the first housing opening, at a chamber contour against the spring force, in a pivoting position directed toward the first spring limb for clamp contacting of the connection conductor that is run into the connection chamber.

An embodiment of the, or of each, spring element provides that the two spring limbs can be connected via an intermediate limb with which the spring element bears against a housing contour within the connection chamber. The intermediate limb is shaped suitably in the manner of an open loop. The housing contour adjusted to the loop shape within the respective connection chamber preferably extends on both sides of the intermediate limb to form a bearing contour for the loop outer side of the spring element and a supporting contour which is enclosed by the looped intermediate limb opening towards to the spring limbs.

Another embodiment provides U-shaped connection rails which rest with both U-connection limbs or with at least one of the two U-connection limbs and the middle limb connecting these on a chamber wall of the connection chamber.

For a particularly simple release of the clamp contacting of a connected connection line, a second housing opening situated parallel to the first housing opening opens into the, or into each, connection chamber, the second housing opening also being covered by the second spring limb in its contact position. The second spring limb can be pivoted by means of a tool directly inserted into the second housing opening. Advantageously, however, an actuating sleeve for indirect pivoting of the second spring limb by means of a tool is arranged in the second housing opening, so that the clamp contacting can be released in a particularly simple, reliable and non-destructive manner and the connection line can be unplugged.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
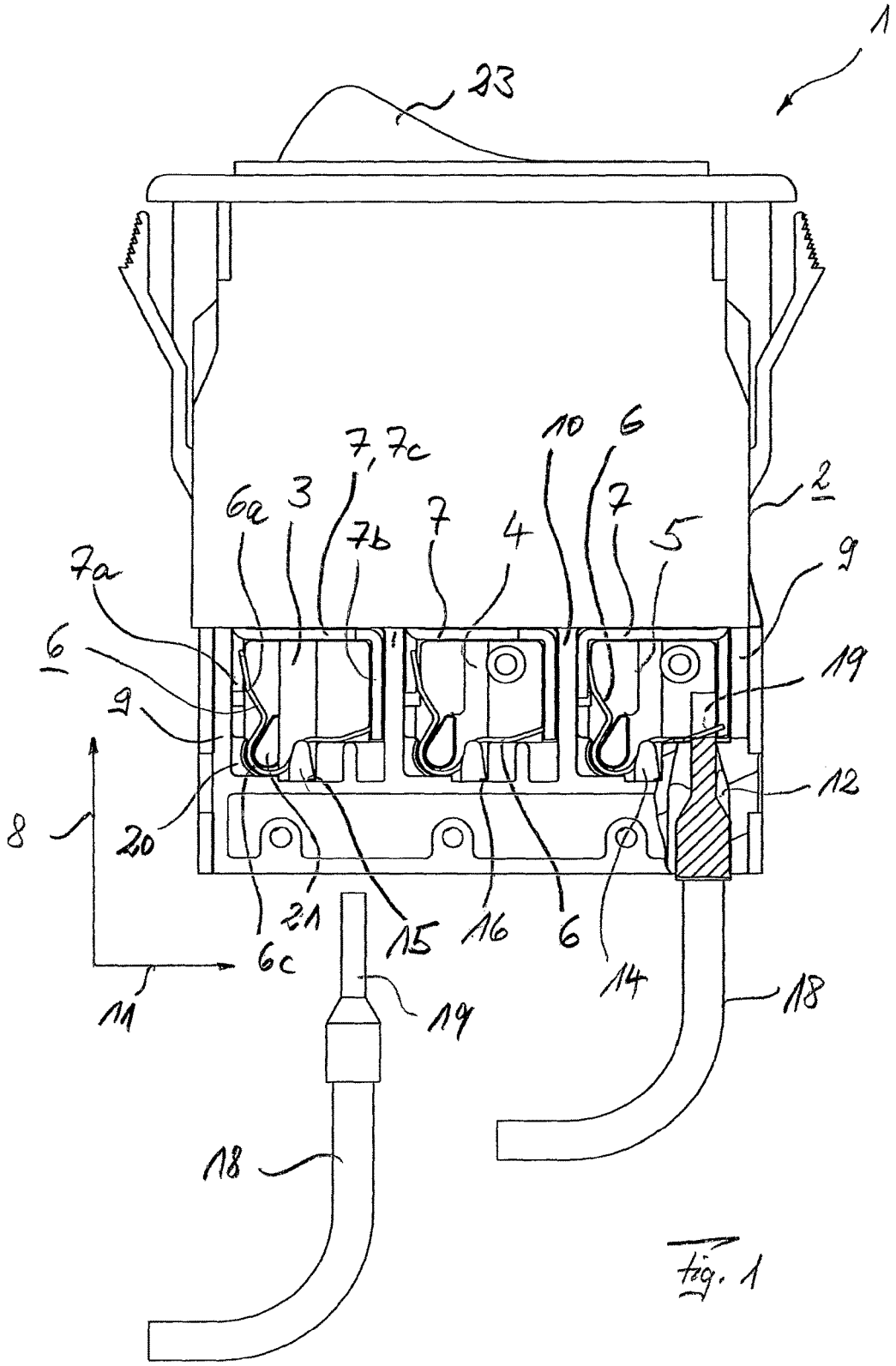
FIG. 1 is a side view of a thermal overload circuit breaker with a view to three connection chambers of a partially opened switch housing.
Figure 2:
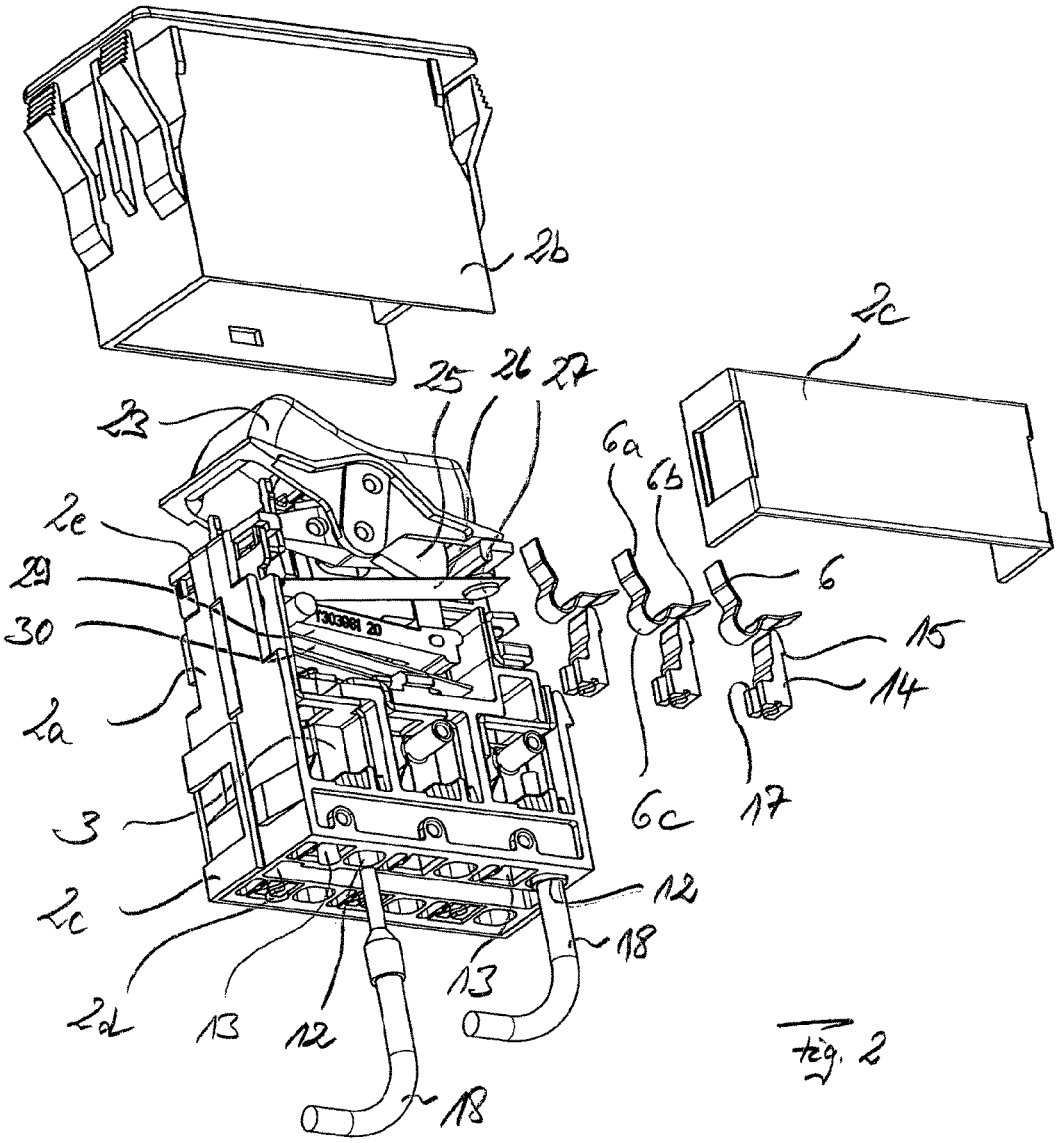
FIG. 2 illustrates the thermal overload circuit breaker in a perspective exploded view.
Figure 3:
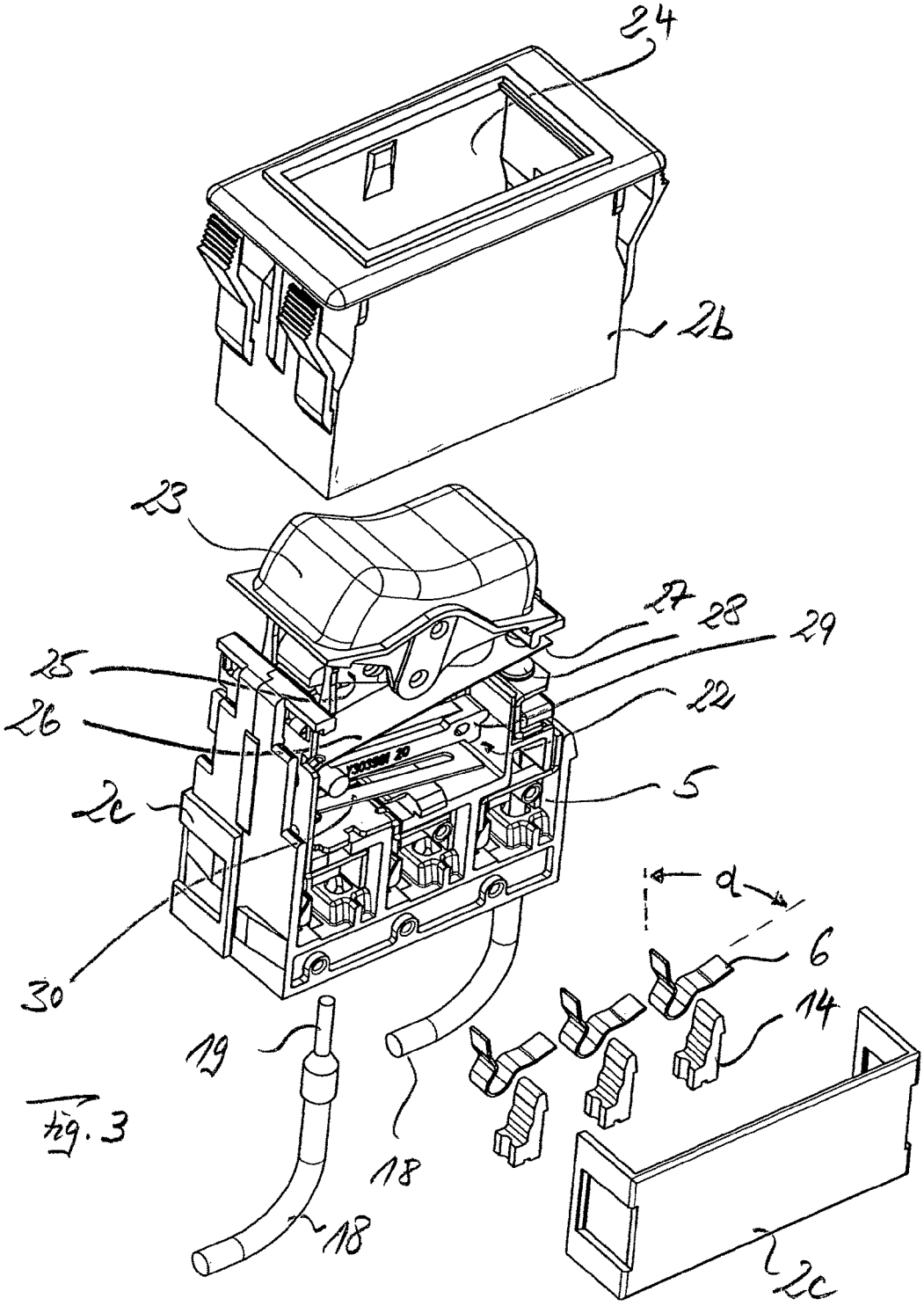
FIG. 3 illustrates the thermal overload circuit breaker in a perspective exploded view that is different than FIG. 2.

FIGS. 1 to 3 show a thermal overcurrent circuit breaker 1 with a switch housing 2, in which in the embodiment, three connection chambers 3, 4, 5 are arranged side by side. In each connection chamber 3, 4, 5, a two-limbed spring element 6 is arranged. In each connection chamber 3, 4, 5, a connection rail 7 is further disposed, which is in each case U-shaped. The U-shape of the respective connection rail 7 is formed by a first rail limb 7*a* extending through the housing longitudinal direction 8 indicated in FIG. 1, and a corresponding, interspaced parallel rail limb 7*b* and a connecting middle limb 7*c*. With these rail limbs 7*a* to 7*c*, the respective connection rails 7 bear against chamber exterior walls 9 or chamber partitions 10. For the sake of clarity, the identical rail limbs of the connection rails 7 in the other two connection chambers 4 and 5 are not further specified.

The same kind of two-limbed spring elements 6 are seated in the connection chambers 3 to 5, which for reasons of clarity, are again not equally or individually designated with regard to the subsequent details. With a first spring limb 6*a*, also referred to as a contact limb, oriented in the longitudinal direction of the housing 8, the respective spring element 6 contacts the rail limbs 7*a* of the corresponding connection rail 7. The second spring limb 6*b* of the respective spring member 6 hereinafter also referred to as a clamping limb is oriented in the housing transverse direction 11, perpendicular to the housing longitudinal direction 8, there covering a first housing opening 12. The respective clamping limb 6*b* of the spring element 6 also covers a second housing opening 13 (FIG. 2) situated parallel to the first housing opening 12. In this, an actuating sleeve 14 closed on one side is seated, which end projects into the respective connection chamber 3, 4, 5, and there bears against the clamping limb 6*b* of the respective spring element 6. Also for reasons of clarity, the similar second housing openings of the other connection chambers 3 and 4 are again not further specified.

The respective actuating sleeve 14 is at least slightly movable in the associated housing opening 13 in the housing longitudinal direction 8. In the assembled state of the actuating sleeve 14, an integrally formed latching nose 15 undercuts an edge contour 16 of the respective housing opening 13 within the respective connection chamber 3, 4, 5. As a result, the actuation sleeve 14 which has a support contour 17 (FIG. 2) for a tool at the opposite insertion end is secured within the respective housing opening 13.

As illustrated in the Figures on the basis of the connection chamber 5 shown there on the right, by means of the spring elements 6, a clamp contacting of a connection line 18 inserted over the first housing opening 12 into the respective connection chamber 3, 4, 5 occurs with the respective connection rail 7 and there, with its respective second rail limb 7*b*. Due to design, assembly and spring force of the spring element 6, the clamp contacting is self-locking. In other words, the respective clamping limb 6*b* can be resiliently pivoted in the insertion direction by means of the connection line 18 or its stripped line end 19 in the housing longitudinal direction 8, thereby also resiliently pivoting towards the contact limb 6*a* by reducing the angle $\alpha$ (FIG. 3) existing between these spring limbs 6*a* and 6*b*. A tensile load on the respective connection line 18 counter to the insertion direction causes, on the other hand, reinforcement of the clamping action with increasing tensile force.

The spring element 6 is mounted precisely positioned in the respective connection chamber 3, 4, 5. To this end, in the area of an intermediate limb 6*c* of the spring element 6, formed in the manner of an open loop and connecting the two spring limbs 6*a* and 6*b*, in the connection chamber 3, 4, 5, a contacting contour 20 and a supporting contour 21 are formed, between which the intermediate limb 6*c* of the spring element 6 is seated.

As can be seen relatively clearly in FIGS. 2 and 3, the switch housing 2 is comprised of several parts. It comprises a housing main body 2*a*, and a housing cap 2*b* as well as two housing covers 2*c*. The housing body 2*a* contains the connection chambers 3 to 5, into which the housing openings 12, 13 open that are introduced into a housing base 2*d*. As can be seen from FIG. 2, the overcurrent circuit breaker 1 is designed 2-poled, so that the connection chambers 3 to 5 and the housing openings 12, 13 opening into the chambers and the connection rails 7 and spring elements 6 are suitably provided in a multiple number.

As seen in the housing longitudinal direction 8 between the connection chambers 3 to 5 and an operating side 2*e* of the switch housing 2, there is a contact chamber 22 (FIG. 3) in which a snap-action switching mechanism is arranged, which cooperates with a switching rocker 23 on the operating side 2*e*. In the assembly state, the housing cap 2*b* covers the housing main body 2*a* from the region of the contact chamber 22. The switching rocker 23 at least partly protrudes through a cap opening 24 of the housing cap 2*b* from the switch housing 2 in order to be manually operated for purposes of a trip-free release. The two housing covers 2*c* are preferably latched to the housing body 2*a* and cover the connection chambers 3 to 5 provided on both sides of the housing main body 2*a*.

The snap-action switching mechanism includes a latching lever 25 coupled to the switching rocker 23, the lever cooperating with a contact spring 26 that supports a movable contact 27 at its free end. Opposite this is a fixed contact 28, which forms a contact pair with the movable contact 27. A tripping lever 29 is coupled with the latching lever 25, the trigger lever in turn cooperating with a thermal expansion element 30 in the form of a U-shaped bimetal. The bimetal 30 is connected via its two U-limbs with the two connection rails 7 in the connection chambers 3 and 4. The connection rail 7 of the connection chamber 3 is in turn electrically connected to the contact spring 26 and through this, with the moving contact 27.

This connection configuration ensures that in an overcurrent circuit breaker 1 arranged between a current/voltage source and a load (consumer), the load current always flows over the bimetal 30 so that in case of overload, i.e., due to an overcurrent, this can trigger the thermal trip. To this end, the bimetal 30 actuates, if necessary as a consequence of its deflection, the tripping lever 29 so that its latch with the latching lever 25 is opened and the contact spring 26 held by the latching lever in the contact position of the contact pair 27, 28 can pivot as a result of the spring restoring force, so that the contact between the moving contact 27 and the fixed contact 28 opens. A contact opening may also be effected manually by means of the switching rocker 23, wherein it is pivoted to the OFF position, thereby manually unlatching the latching lever 25.

The thermal overcurrent circuit breaker 1 is designed for DC and AC voltages in the low voltage range (250V AC and 50V DC or 65V DC) with current ratings between 0.05 A and 20 A and provided in particular for the protection of electrical machinery, electrical systems of vehicles, transformers and low voltage lines. Connection lines 18 with a conductor cross-section in the range between 0.14 $mm^2$ and 4 $mm^2$ can hereby be contact-clamped, wherein not only rigid, but also uncompressed and compressed flexible connection lines can be used with or without a core sleeve, with or without a plastic sleeve.

The invention is not limited to the embodiments described above. Rather, other variations of the invention can be derived therefrom by those skilled in the art without departing from the scope of the invention. In particular, moreover all individual features described in the context of the embodiments can be combined with each other in other ways without departing from the scope of the invention.

What is claimed is:

1. A thermal overcurrent circuit breaker comprising:

a switch housing in which a manually operated snap-action switching mechanism and a bimetal thermal expansion element cooperating therewith, and a moving contact cooperating with the snap-action switching mechanism and a fixed contact, are arranged, the fixed contact being connected to a first connection rail and the moving contact being connected to a second connection rail via the bimetal thermal expansion element; and a housing main body arranged in the switch housing, the housing main body having a plurality of connection chambers, an operating side and a contact chamber positioned between the plurality of connection chambers and the operating side, wherein both the snap-action switching mechanism and the bimetal thermal expansion element are arranged in the contact chamber, wherein, in each connection chamber, one of the connection rails and a two-limbed spring element for clamp contacting a connection line guided via a first housing opening into the connection chamber is arranged, the spring element having a first spring limb and a second spring limb, wherein a second housing opening, substantially parallel to the first housing opening and covered by the second spring limb in a contact position, opens into the respective connection chamber for pivotal actuation of the second spring limb, and wherein the contact chamber, the connection chambers and the spring element in each of the connection chambers are integrated into the housing main body of the switch housing, the housing main body being a single piece housing, wherein the first spring limb of the spring element is supported in a contacting manner on a first rail limb of the connection rail and the second spring limb of the spring element extends at an angle equal to 90° to the first spring limb, wherein the second spring limb completely covers the second housing opening, and wherein an actuating sleeve with a supporting contour for a tool is inserted or insertable in the second housing opening for the indirect pivotal actuation of the second spring limb.

2. The thermal overcurrent circuit breaker according to claim 1, wherein seen in the direction of the free end of the second spring limb of the spring element, the second housing opening is arranged upstream of the first housing opening in each connection chamber.

3. The thermal overcurrent circuit breaker according to claim 1, wherein the actuating sleeve is at least slightly movable in the second housing opening in the housing longitudinal direction.

4. The thermal overcurrent circuit breaker according to claim 1, wherein on the actuating sleeve, a latching nose is formed, which in the assembled state of the actuating sleeve undercuts an edge contour of the second housing opening within the respective connection chamber.

5. The thermal overcurrent circuit breaker according to claim 1, wherein, within the respective connection chamber, the second spring limb of the spring element is moveable against the spring force from the contact position at least partially overlapping the second housing opening and the first housing opening into a pivot position directed toward the first spring limb for clamp contacting the connection line that is guided via the first housing opening into the connection chamber.

6. The thermal overcurrent circuit breaker according to claim 1, wherein the first and second spring limbs of the spring element are connected by an intermediate limb shaped in the manner of an open loop, and wherein within the connection chamber, the connection chamber has a contacting and/or supporting contour adapted to the loop shape between which the intermediate limb bearing thereon is seated.

7. The thermal overcurrent circuit breaker according to claim 1, wherein the connection rails each have a U-shape with a first rail limb, a second rail limb and a middle limb connecting the first and second rails limbs, and bear on a chamber wall of the respective connection chambers with at least one of the first rail limb, the second rail limb and/or the middle limb.

8. The thermal overcurrent circuit breaker according to claim 1, wherein the snap-action switching mechanism has a latching lever coupled with a manually operable switching element or a switching rocker, and cooperating with a contact spring supporting the moving contact and a tripping lever coupled thereto, which cooperates with the bimetal thermal expansion element.

9. The thermal overcurrent circuit breaker according to claim 8, further comprising a third connection rail directly connected to the contact spring supporting the moving contact thereon and connected to the second connection rail via the bimetal thermal expansion element.

10. The thermal overcurrent circuit breaker according to claim 1, wherein the first and second spring limbs of the spring element are connected by a curved intermediate limb, wherein the connection chamber has a contacting contour portion having a contour that conforms to a contour of an outer surface of the intermediate limb and a supporting contour portion having a contour that conforms to a contour of an inner surface of the intermediate limb, the inner surface opposing the outer surface, and wherein the intermediate limb bears upon the contacting contour portion and the supporting contour portion.

* * * * *